United States Patent [19]

Kriegler

[11] 4,229,943

[45] Oct. 28, 1980

[54] STEAM ENGINE

[76] Inventor: Franz Kriegler, Arndesstieg 3, Hamburg, Fed. Rep. of Germany, D-2000

[21] Appl. No.: 789,343

[22] Filed: Apr. 20, 1977

[51] Int. Cl.[3] ..... F01K 13/02

[52] U.S. Cl. ..... 60/652; 60/661; 60/686; 91/247; 91/330

[58] Field of Search ..... 60/643, 645, 652, 647, 60/660, 661, 670, 686; 91/454, 54, 152, 187, 247, 330

[56] References Cited

U.S. PATENT DOCUMENTS

| | | | |
|---|---|---|---|
| 740,203 | 9/1903 | Thomson | 91/187 |
| 935,194 | 9/1909 | Edgar | 91/187 |
| 3,978,672 | 9/1976 | Stenger | 60/670 |

*Primary Examiner*—Allen M. Ostrager
*Assistant Examiner*—Stephen F. Husar
*Attorney, Agent, or Firm*—Peter K. Kontler

[57] ABSTRACT

A steam engine wherein the inlet and relief valves are subjected to balanced stresses and the pressure of steam is maintained above the critical point. The engine can be braked electrically, mechanically and with steam; the braking with steam takes place subsequent to the application of electrical and mechanical brakes. The engine is equipped with arrangements for venting the steam path prior to starting, for replenishing the supply of fluid in order to compensate for leakage through the valves and/or from the engine cylinders, and with a control system which partly opens the relief valves and closes the inlet valves in response to actuation of the steam brake.

17 Claims, 27 Drawing Figures

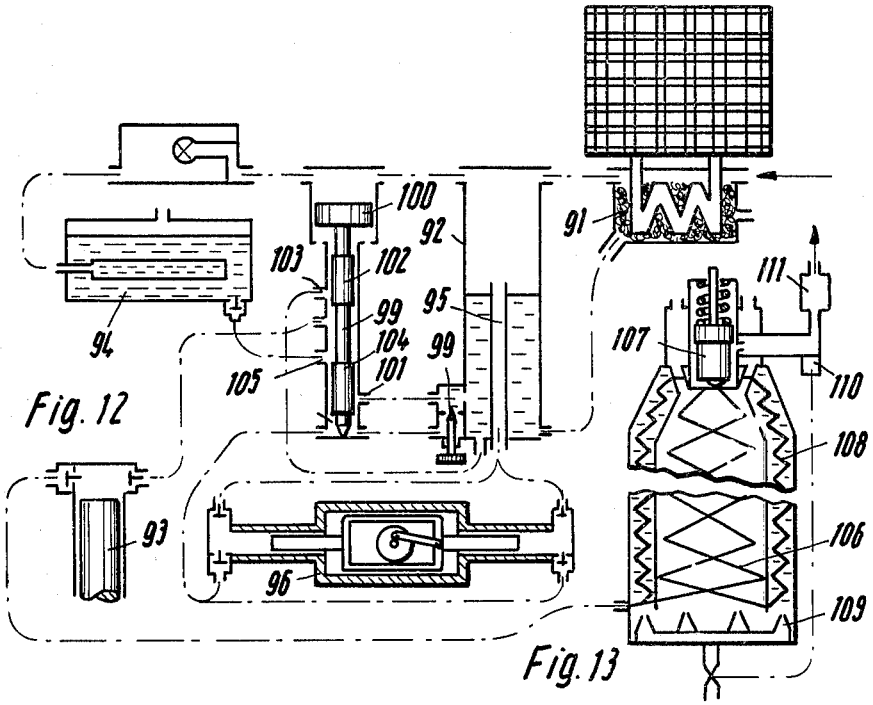
Fig. 12
Fig. 13
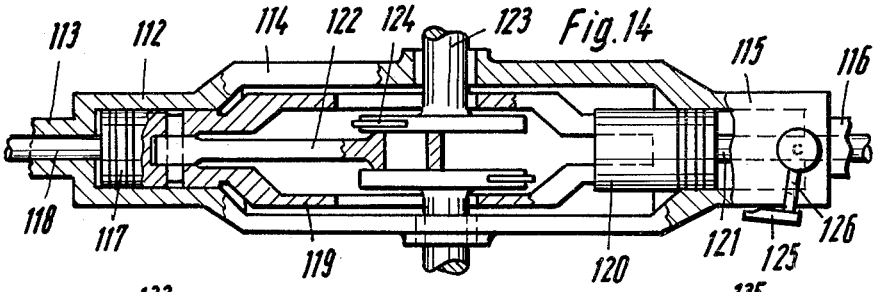
Fig. 14
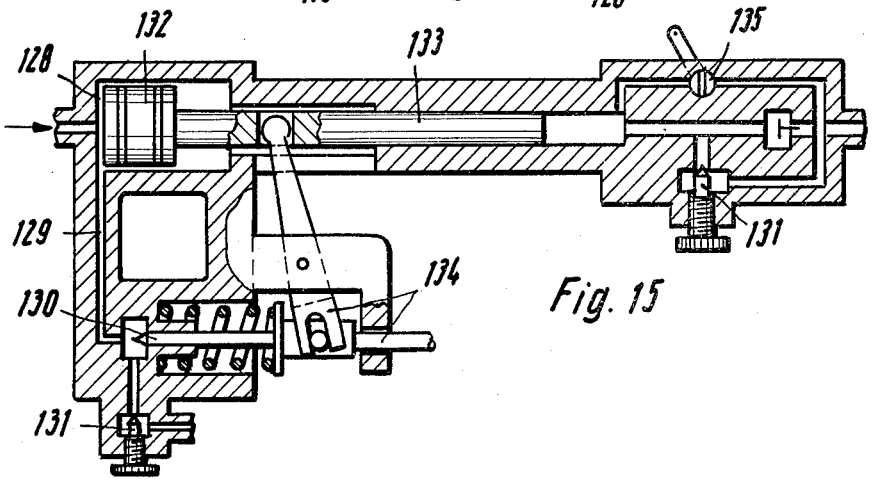
Fig. 15

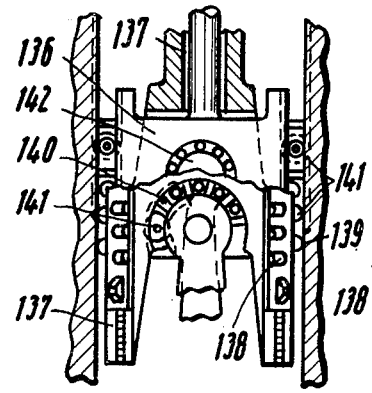
Fig. 16
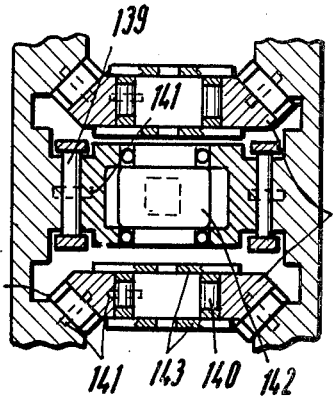
Fig. 17
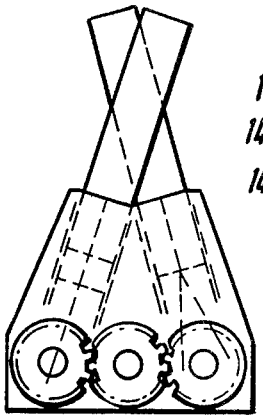
Fig. 18
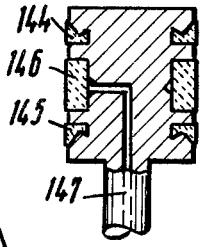
Fig. 19
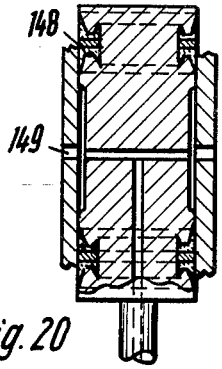
Fig. 20
Fig. 21
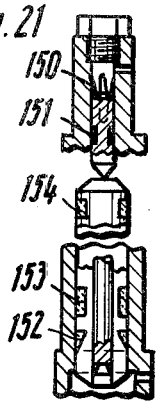
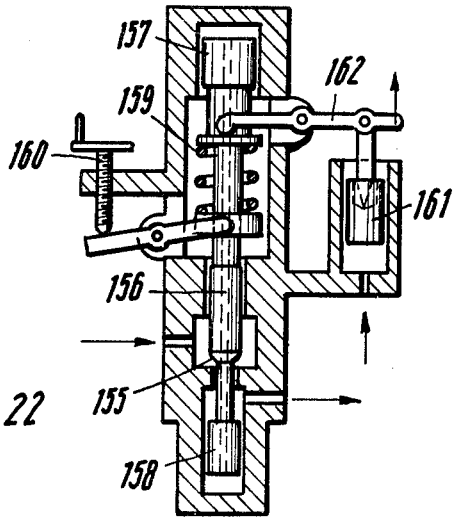
Fig. 22
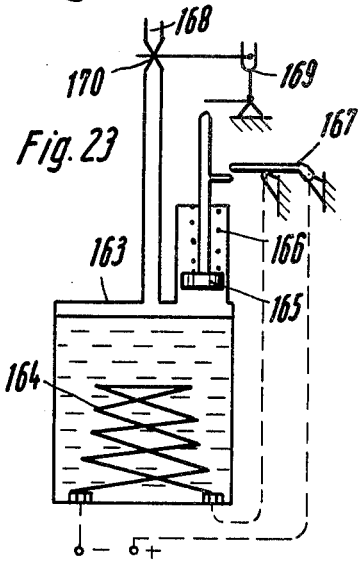
Fig. 23

STEAM ENGINE

BACKGROUND OF THE INVENTION

The present invention relates to steam engines in general, and more particularly to improvements in engines of the type which operate with steam at a pressure above the critical point. Still more particularly, the invention relates to improvements in steam engines wherein the fluid medium whose heat energy is converted into mechanical energy is circulated along a closed path.

Presently known steam engines of the above outlined character operate with a working medium whose pressure is below the critical point. The upper limits of steam temperature and pressure in such engines are respectively about 500° C. and 140 atmospheres superatmospheric pressure. This is satisfactory for certain applications; however, these engines also exhibit a number of serious drawbacks. Thus, the conversion of heat energy into mechanical energy takes place in the lower steam-liquid range even though it is well known that the efficiency of steam engines which operate in the higher range is much more satisfactory. When the operation takes place in the lower steam-liquid range, the medium must be supplied with additional evaporation heat subsequent to each passage through the engine cylinder or cylinders. In the so-called gas range (i.e., at a temperature above the critical temperature of 374° C. and above the critical pressure of 225 kg/cm$^2$), there is no need to supply evaporation heat for conversion of liquid into steam. Presently known steam engines cannot operate in the gas range for a number of reasons. Thus, in order to insure that the relatively small temperature gradient which is available in conventional machines will be converted into work to a maximum extent such engines are equipped or provided with means for condensing spent steam by cooling. According to the Sankey diagram, heat losses which develop in the condenser amount to 62 percent. Boiler losses equal or approximate 21 percent and other losses amount to 3 percent. Even though the heat energy of spent steam can be put to use, only 14 percent of the total heat energy is available for conversion into mechanical energy. It was also proposed to resort to condensation by compression (instead of cooling); however, the procedure is impractical because of the low pressure gradient which is available for conversion into mechanical energy.

Steam boilers which are used in combination with conventional engines operate at a relatively low pressure; this, combined with the low heat content of the working medium, necessitates the use of huge boilers if the engine requires a substantial energy input. A large boiler requires a long period of time for heating to operating temperature and the losses owing to radiation are very pronounced due to the large surface areas of such boilers. Moreover, explosion of a large steam boiler can cause substantial damage and/or injuries.

Boiler feed pumps which are used in connection with steam engines for vehicles are operated individually and directly by steam. Such pumps are not suited for operation in parallel which would be desirable in order to insure a more uniform admission of fluid. Also, the bodies of sliding and lifting valves which are used in conventional steam engines contain large dead spaces which cause substantial losses in flow. The lack of efficiency of such valves would be even more pronounced if the valves were used in or on the relatively small cylinders which are operated with steam whose pressure is in the supercritical range, i.e., the ratio of the aforementioned dead spaces to the volume of the cylinders would be even less satisfactory. Also, the valve regulating devices of presently known steam engines operate with pronounced inertia so that they cannot insure an accurate and reproducible rate of steam flow into and/or from the cylinders of the engine. As a rule, such regulating devices operate exclusively in dependency on the RPM of the crankshaft. If one were to use steam which is maintained at a pressure in the supercritical range, the RPM could be increased very substantially and the conventional regulating slide devices would be capable of controlling the movements of valves at the increased speed. However, once the speed of moving parts of valves exceeds a certain limit, they are subjected to excessive wear, mainly because of poor lubrication. Moreover, the valves are normally biased to closed position by springs, especially steel springs, which are subjected to pronounced thermal stresses. Furthermore, the characteristic resonant frequency of such springs is limited so that the closing of valves is not assured once the RPM of the crankshaft exceeds a certain limit. Certain other types of valves, e.g., Meier-Mattern valves and others which are operated with pressurized oil, exhibit many advantages over mechanically operated valves, particularly as concerns the speed of movement of valving elements between open and closed positions, lower inertia and simplicity of reversing the direction of movement. The pressure of oil is regulated substantially in dependency on the load upon the engine by resorting to an oil pressure regulator which insures that the duration of intervals during which the valves remain open varies with the speed of the engine. However, such regulating devices also exhibit a number of drawbacks. Thus, when the pressurized oil opens a valving element, oil flows into a container (which is mounted at a high level) and thence back to the oil pump. The circuit for the flow of oil is open and, therefore, one cannot compensate for pressure losses due to elasticity of oil and resistance which the oil encounters during flow in the piping, especially in the supercritical range when the rotational speed is extremely high and strokes are very short.

OBJECTS AND SUMMARY OF THE INVENTION

An object of the invention is to provide a novel and improved engine which can be operated at steam pressure above the critical point.

Another object of the invention is to provide a steam engine which is more efficient and more compact than heretofore known engines.

A further object of the invention is to provide an engine wherein the temperature of fluid can be rapidly raised to operating temperature.

An additional object of the invention is to provide an engine wherein losses due to radiation are relatively low and eventual malfunctioning or breakdown of the evaporator does not cause substantial damage and/or danger to attendants.

Another object of the invention is to provide an engine wherein the moving parts can be lubricated without contact between steam and lubricant.

An ancillary object of the invention is to provide a novel and improved control system for the valves of the above outlined engine.

A further object of the invention is to provide novel and improved pistons and novel and improved regulators for use in the above outlined engine.

An additional object of the invention is to provide an engine which embodies the above outlined features and can be utilized with advantage as a means for propelling road vehicles or rail-mounted vehicles.

The invention is embodied in a steam engine for conversion of all kinds of heat energy into mechanical energy. The engine comprises engine cylinder means, reciprocable piston means in the cylinder means, rotary output means driven by the piston means, inlet valve means having mobile valving means for admission of steam into the cylinder means, relief valve means for evacuation of fluid from the cylinder means, means for biasing the valve means to closed positions, linkages or analogous means for balancing the forces acting upon the valve means so as to subject the latter solely to the bias of the biasing means in the open and closed positions of the valve means in each of which the valving means of the inlet valve means is subjected to the pressure of fluid in the cylinder means, variable-ratio motion transmitting means for superimposing the just mentioned pressure upon the force which is furnished by the respective biasing means to that the action of closing moment upon the valving means of the inlet valve means prevails over the pressure, selector means movable to a plurality of positions for varying the pressure of steam which is admitted into the cylinder means by way of the inlet valve means, means for opening the valve means and for simultaneously changing the degree of filling of the cylinder means with steam, condenser means, pump means, regulating means for conforming the degree of filling of the condenser means to the operation of the pump means so as to achieve an optimum thermal efficiency by raising the condensation point to a maximum and to achieve maximum output by lowering the condensation point to a minimum, speed-responsive governor means, torque-responsive regulator means, and transmission and switching means for changing the output in dependency on the momentary condition by adjusting, opening and/or closing the valve means as a function of the sum of selected values and indications furnished by the governor means and regulator means.

The novel features which are considered as characteristic of the invention are set forth in particular in the appended claims. The improved steam engine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 12 is a schematic partly elevational and partly sectional view of a system for replenishing the supply of fluid in the condenser;

FIG. 13 is a sectional view of an evaporator;

FIG. 14 is a sectional view of a control pump;

FIG. 15 is a sectional view of a venting regulator;

FIG. 16 is a fragmentary sectional view of crossheads in the engine;

FIG. 17 is a sectional view taken at right angles to the plane of FIG. 16;

FIG. 18 is a fragmentary elevational view of several counterflow cylinders in X-formation;

FIG. 19 is a sectional view of a piston;

FIG. 20 is a sectional view of a modified piston;

FIG. 21 is a sectional view of a portion of a valve;

FIG. 22 is a sectional view of a regulator for the feed pump;

FIG. 23 is a schematic sectional view of a preheating device for fluid;

DESCRIPTION OF THE PREFERRED EMBODIMENTS

Figure 1:
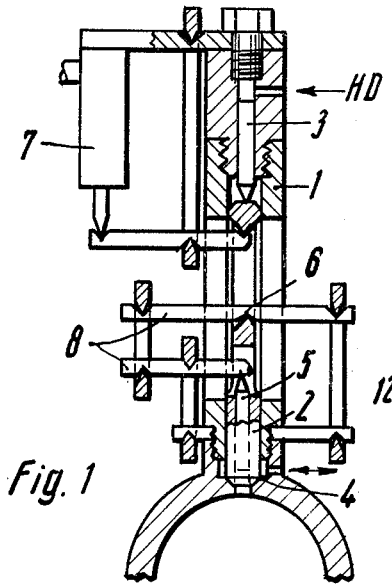
FIG. 1 is a schematic partly elevational and partly sectional view of a relief valve which is constructed and assembled in accordance with a feature of the invention and comprises mechanical pressure relieving means.

FIG. 1 shows a relief or overflow valve which is mounted on the cylinder of a steam engine and comprises a valve body 1 for a piston-like reciprocable valving element 2. The outer end of the element 2 is urged toward the seat 4 of the body 1 by a biasing piston 3 whose outer end face is subjected to full operating steam pressure (HD). The valving element 2 receives a reciprocable balancing or equalizing piston 5 (this piston can be installed in a separate cylinder which communicates with the engine cylinder). The lower end faces of the valving element 2 and piston 5 are subjected to the pressure of fluid in the engine cylinder. A median portion of the valving element 2 defines a knife edge bearing 6 for a tiltable beam forming part of a linkage 8 which further includes a beam abutting the outer end of the piston 5. The linkage 8 can be replaced by other motion transmitting and/or force multiplying means. The valving element 2 can be moved to open position by a control cylinder 7 which acts upon a further beam fulcrumed in a second knife edge bearing close to the outer end of the element 2. It is equally within the purview of the invention to employ a purely mechanical control device which can be actuated to move the valving element 2 to the open position. Irrespective of the (open or closed) position of the element 2, the pressures which are applied to the end faces of 2 and 5 are balanced by the linkage 8 in such a way that the element 2 is biased only by the piston 3.

Figure 2:
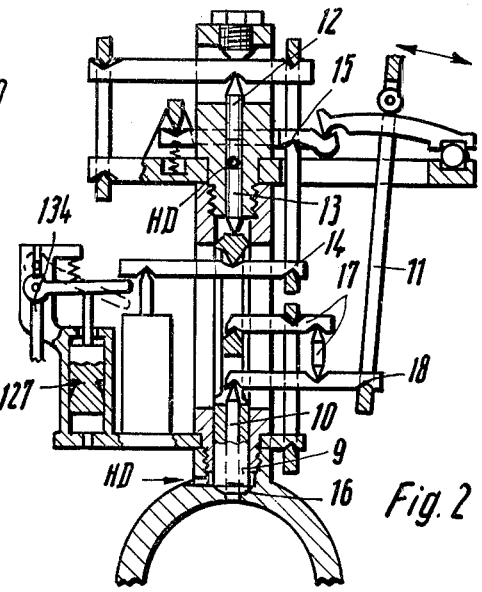
FIG. 2 is a schematic partly elevational and partly sectional view of an inlet view which is constructed and assembled in accordance with a feature of the invention.

FIG. 2 shows an inlet valve whose body is mounted on the engine cylinder and whose valving element or piston 9 is associated with a balancing or equalizing piston 10. The seat for this element 9 is shown at 16. When the element 9 is lifted off its seat 16, steam can enter the engine cylinder in the direction indicated by the arrow (HD). The element 2 is relieved by subjecting both of its end faces to operating pressure of steam. The biasing piston is shown at 13, and the reference character 11 denotes a steering member having a bearing 18 for one element of a linkage 17 which engages the outer end of the piston 10 and is fulcrumed in the valving element 9. The piston 13 is located opposite a piston 12 which is subjected to the pressure of steam (HD) entering into the space between the pistons 12 and 13. The piston 12 bears against one element of a second linkage 15 whose position can also be changed by pivoting the steering member 11. In this manner, one can regulate the admission of steam into the cylinder of the engine. The linkage 15 is preferably designed in such a way that the part 14 which engages the outer portion of the valving element 9 and serves to move the element 9 to the open position is held in the illustrated position with a force which exceeds the oppositely directed force.

When steam is permitted to flow into the engine cylinder, it acts against the inner end face of the piston 10 as well as against the seat 16. The pressure is relieved irrespective of the actual pressure of steam; however, the force acting against the bearing for the member 14 of the linkage 15 varies because, as the pressure of steam acting against the outer end faces of the valving element 9 and piston 10 increases, such pressure is applied to the member 14.

The steering member 11 acts as a pivot for the linkage 17. When the pressure of steam in the engine cylinder increases, the pressure upon the bearing 18 also increases, and such pressure can be superimposed by member 11 (in adjustable manner) upon the pressure which is applied by the piston 13 (via the linkage 15). When the pressure of piston 13 plus the pressure transmitted by steering member 11 exceeds the holding pressure of piston 12, the valving element 9 moves to the closed position. The timing of closing depends on selected position of the steering member 11, i.e., this member determines that pressure at which the valve of FIG. 2 closes.

Figure 3:
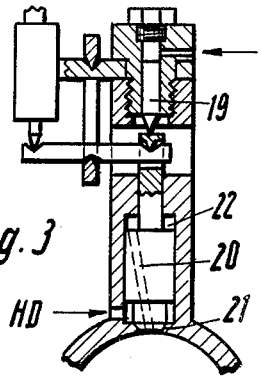
FIG. 3 is a similar view of a modified inlet valve with a differential piston.

FIG. 3 shows a second inlet valve with a biasing piston 19 and a relief orifice 20. The valving element is a differential piston whose end faces are shown at 21 and 22. The admission of steam (in open position of the valving element) takes place in the direction indicated by arrow HD. The end faces 21, 22 insure a balanced relief action.

Figure 4:
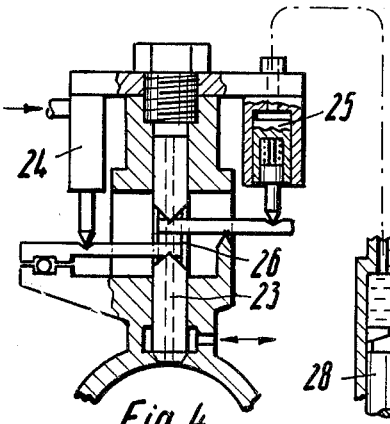
FIG. 4 is a similar view of a third inlet valve.

The valve of FIG. 4 constitutes a modification of the valve which is shown in FIG. 3. This valve has a relief orifice 23 which fully balances the pressure at the two end faces of the valving element. The biasing piston 24 cooperates with an auxiliary control piston 25 by way of discrete linkages fulcrumed in bearings provided in one and the same slot 26 of the valving element. The piston 24 tends to move the valving element toward the closed position, and the piston 25 tends to move the valving element toward the open position.

Figure 5:
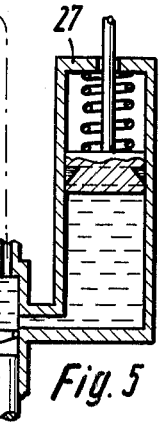
FIG. 5 is a sectional view of a pressurizing cylinder for hydraulic fluid which is used to effect opening of the inlet valve of FIG. 4 and to eliminate clearances between moving parts of the valve.

Referring to FIG. 5, there is shown a cylinder 27 which effects pressurization of oil for admission into the cylinder for the auxiliary control piston 25 of FIG. 4. The spool 28 of a regulating valve between the cylinder 27 and the cylinder for the piston 25 is shown in the neutral position. This spool is provided with suitably inclined and configured control edges or shoulders for regulation of oil flow from the cylinder 27 into the cylinder for the piston 25. Pressurizing of oil is desirable because it insures that the piston 25 eliminates any play between the relatively movable parts of the valve of FIG. 4, regardless of whether the steam engine is idle or running. When the engine is idle, the biasing piston 24 moves upwardly, as viewed in FIG. 4, due to generation of vacuum in response to condensation of steam in the pipe 24*a* which admits steam to the chamber above the piston 24. The springs in the cylinder for the piston 25 then move the valving element upwardly to maintain the left-hand linkage in engagement with the piston 24.

Figure 6:
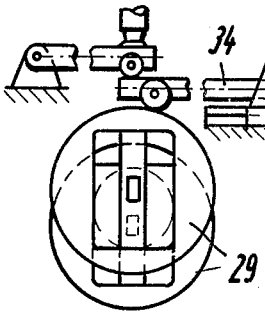
FIG. 6 is a fragmentary elevational view of a control system for the valves in the steam engine.
Figure 7:
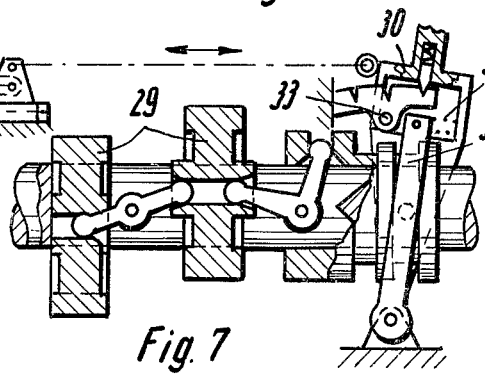
FIG. 7 is a fragmentary partly elevational and partly sectional view of another portion of the control system.
Figure 9:
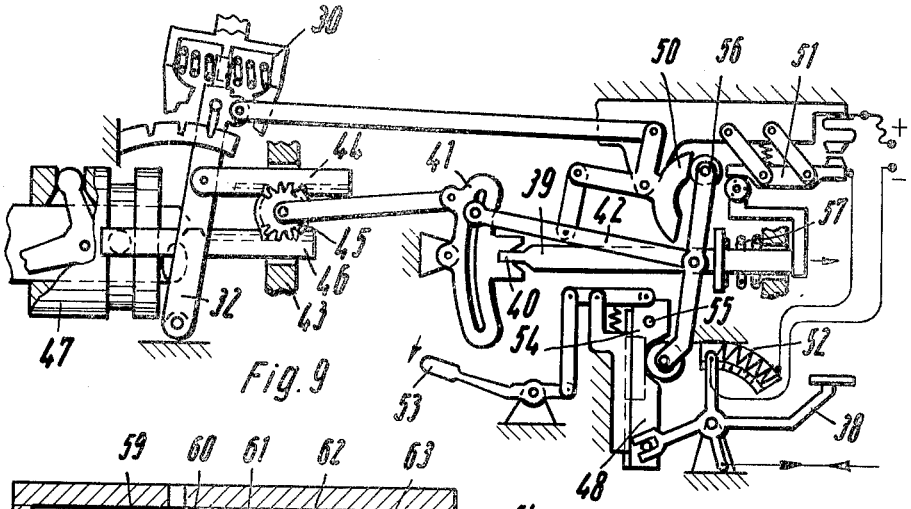
FIG. 9 is a partly elevational and partly sectional view of a portion of the control system and of the brake actuating means in an engine which is used to drive a vehicle.

FIGS. 6 and 7 show a portion of a control unit (see also FIG. 9). This control unit comprises disk-shaped cams 29 which are shown in the zero position. In order to move the cams 29 from the zero position to one of two operative or working positions, the control unit comprises a movable selector 30 which is coupled with a starter lever 32 by means of spring 31. When the selector 30 is moved to a position corresponding to one working position of the cams 29, the starter lever 32 is held by a blocking device 33 as long as the steam pressure is below the operating pressure. When the operating pressure is reached, the blocking device 33 releases the starter lever 32 and the latter is pivoted by the stressed spring 31 to the operative position. The shifting of selector 30 to a working position results in corresponding displacement of a linkage 34 which insures that steam flows in the selected direction, i.e., to rotate the output shaft of the steam engine in the desired direction. The linkages 34 can be replaced by other types of adjusting means, e.g., by a spindle having steep threads and serving as a centrally journalled connector between the drive shaft and the control shaft. The postion of the linkage 34 is continuously corrected by a centrifugal governor (see the member 70 in FIG. 11) through the medium of suitable motion transmitting means, not shown.

The inlet valves of the engine cylinders are closed and the relief or discharge valves are open in the zero position of cams 29.

Figure 8:
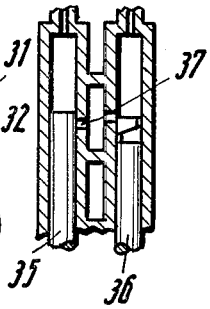
FIG. 8 is a sectional view of a portion of a pump in the improved engine.

FIG. 8 shows the plunger 35 of a pump which controls the relief valve. The position of the plunger 35 corresponds to the zero position of the cams 29 shown in FIG. 6. The piston 35 then seals an oil admitting port 37. The associated relief valve is open. The pump plunger 36 controls the inlet valve and does not block the oil admitting port even if one employs an adjustable selector (such as the member 69 in FIG. 11) without blocking means. The selector 69 is fixed in the operative position.

The control unit of FIG. 9 comprises a resetting transmission for braking and is especially suited for use in steam engines for vehicles. The brake actuating pedal 38 of the control unit can be depressed in order to initiate a braking action. The depression of pedal 38 results in displacement of a blocking lever 39 by way of suitable motion transmitting elements so that the lever 39 leaves the notch 40 of a pivotable guide 41 having an arcuate slot for the follower of a rod 42. The rod 42 is moved in response to depression of the pedal 38 whereby the follower causes the guide 41 to pivot about its fulcrum and to operate a rack-and-pinion differential 43. During braking, the starter lever 32 holds the corresponding toothed rack 44 of the differential 43 against movement. The guide 41 moves the pinion 45 which causes the rack 46 of the differential 43 to move the cams 29 of FIG. 6 to the zero position. The operative connection between the cams 29 and the rack 46 includes a pusher 47. Thus, the cams 29 are automatically moved to zero position when the braking pedal 38 is depressed to initiate a braking action.

When the selector 30 is shifted in order to move the starter lever 32 to an operative position, the guide 41 holds the pinion 45 against movement along the racks 44, 46. Thus, as the starter lever 32 changes its inclination, the rack 44 rotates the pinion 45 which, in turn, changes the position of the rack 46 and pusher 47 so that the cam 29 are moved to the corresponding operative position for the selected direction of rotation.

As shown in FIG. 9, the starter 32 is coupled to the rod 42 by a linkage including the member 50 so that the rod 42 assumes a corresponding position. If the vehicle is to be braked by admission of steam into the engine cylinders, the plunger 35 of FIG. 8 is set to perform short steam throttling strokes and the plunger 36 of FIG. 8 is also adjusted by appropriate linkage in response to depression of the pedal 38 so that it permits the associated inlet valve to operate with short steam admitting strokes. The linkage 34 of FIG. 6 is also adjusted in response to depression of the pedal 38 so that the admission of steam takes place in a median range of the piston stroke. The linkage 34 can be adjusted by means of a device resembling a turnbuckle having a sleeve for two rods which move in opposite directions in response to rotation of the sleeve. The sleeve has right-hand and left-hand internal threads.

It is preferred to employ the steam brake as an emergency brake which is applied subsequent to the application of an electric brake and a mechanical brake. When the pedal 38 is depressed, a cam 48 pivots a follower 49 which also engages the cam 50 of the linkage between the rod 42 and starter lever 32. The cams 29 are thereby set to zero position and the follower 49 actuates a switch 51 in circuit with the winding of the electric brake. The brake pedal 38 also adjusts a variable resistor 52 or another suitable electrical component. The brake receives electrical energy from a generator whose rotor is driven by the output shaft of the engine and whose induced voltage is regulated by the resistor 52. The generator also supplies electrical energy to the evaporator of FIG. 13, e.g., to the storing device 108 for latent heat energy which surrounds the evaporator. The storing device 108 can be mounted to surround the output element. The manner in which the device 108 may be heated is analogous to that which is resorted to in low-frequency inductive heating of metal melting furnaces. Other methods of heating can be used just as well (see FIG. 23).

When the brake is applied, the RPM of the output element of the engine decreases and the energy output of the generator is reduced. This necessitates an adjustment in the position of the pedal 38 in order to compensate for the less pronounced action of the electric brake or to cause the generation of a more pronounced braking action. The aforementioned mechanical brake is applied when the RPM of the output element is reduced to such an extent that the electric brake is incapable of furnishing the necessary braking action. When braking with steam, the operator pivots an actuating lever 53 (FIG. 9) which displaces a cam 54 and hence the follower 49 so that the cams 29 are moved from the zero position and are set to effect an advanced admission of steam. The inlet valves are open and the relief valves throttle the flow of fluid from the engine cylinders. The movement of the cam 48 in response to actuation of the lever 53 is limited by a stop 55. The latter prevents the actuation of steam brake when the engine is idle. This stop is controlled by the centrifugal governor. When the vehicle which is driven by the engine is at a standstill while the mechanical brake is applied, and the selector 30 is held in a position corresponding to a working position of the starter lever 32, the cams 29 are held in the zero position. When the selector 30 is moved to zero position, the cam 50 is displaced and the roller 56 of the two-armed follower 49 (which is biased by the spring 57) moves along the cam 50 to insure that the cams 29 remain in the zero position even if the position of the selector 30 is changed during braking.

If the steam brake is applied (by way of actuating lever 53) while the electrical and/or mechanical brake furnishes braking torque, the magnitude of braking force supplied by the steam brake is preferably regulated in conformity with the braking torque furnished by the other brake or brakes so as to achieve a predictable braking effect. The means for automatically regulating two or more simultaneous braking actions is not specifically shown in the drawing.

Figure 10:
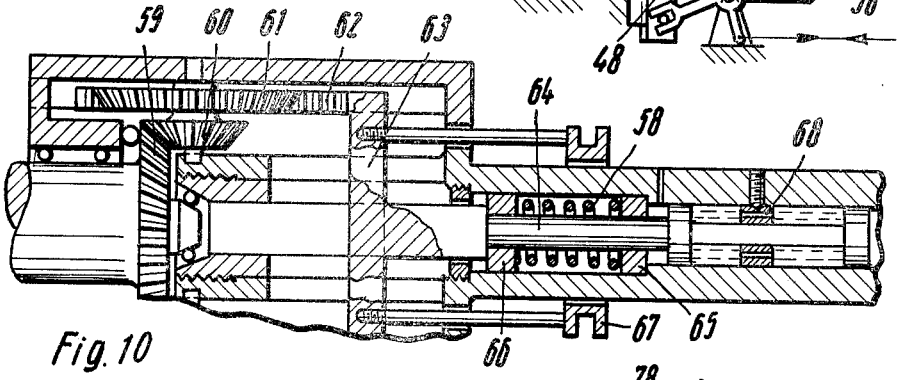
FIG. 10 is a fragmentary sectional view of a torque-responsive regulator.

FIG. 10 shows a torque-responsive regulator wherein the torque is measured by a spring 58 which is subjected to axial stresses. If the spring is relatively weak, the moment is preferably applied by means of a suitable transmission such as the one which is shown in FIG. 10 and includes bevel gears 59, 60, 61, toothed racks 62, a yoke 63 and a push rod 64. Depending on the direction to rotation, the rod 64 tensions the spring 58 by way of a ring 65 or a ring 66 whereby the degree of tensioning denotes the magnitude of torque. The magnitude of measured torque is indicated by the position of a ring 67.

If the regulator comprises two radially disposed springs, the torque transmitting system is designed to subject one of the springs to stresses which denote the magnitude of torque during rotation in a first direction. The other spring, which is also disposed radially and is axially offset with respect to the one spring, remains unstressed. If the direction of rotation is changed, the one spring remains unstressed and the other spring is stressed to the extent determined by the magnitude of applied torque. The extent to which the one or the other spring is stressed is indicated by the position of a ring which receives motion from suitable motion transmitting means (such means may include an inclined groove). Each type of torque-responsive regulator preferably comprises damping means (see the damping or cushioning device 68 of FIG. 10).

The regulator of FIG. 10 monitors the transmission of power from the engine to the output shaft and cooperates with a centrifugal governor (shown at 70 in FIG. 11) to control the pump or pumps which control the inlet and relief valves.

Figure 11:
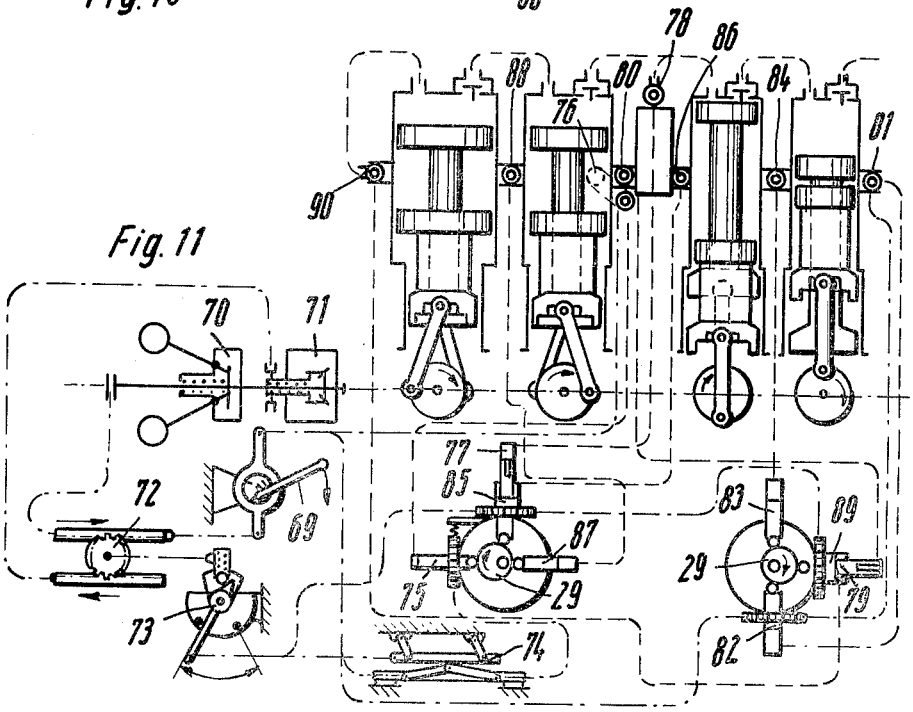
FIG. 11 is a diagrammatic view of a steam engine with four cylinders for counterflow operation.

FIG. 11 illustrates the controls for a steam engine with four cylinders. The selector 69 can regulate the pressure of admitted steam within a wide range. In order to insure rapid and smooth reaction in response to changes in the position of the selector 69, the signals furnished by the selector 69 are superimposed upon signals furnished by a centrifugal governor 70 and a torque-responsive regulator 71. The governor 70 regulates the RPM and the output by shifting from parallel operation of cylinders or cylinder groups to compound operation or vice versa. The governor 70 performs such functions together with the regulator 71.

When the engine is started and does not immediately encounter a substantial resistance to rotation of the output element, the governor 70 closes the inlet valve 76 by way of a differential 72, switching devices 73, 74 and the plunger 75 of a control pump. At the same time, a second plunger 77 of the pump closes a bypass line for a relief valve 78, and a third plunger 79 deactivates a relief valve 80. Thus, only the inlet valve 81 admits steam during such mode of operation. The plungers 75 and 77 are idle, and the associated valves are closed. The plunger 82 of the pump regulates the operation of the inlet valve 81, a further plunger 83 controls the relief valve 84, an additional plunger 85 controls the relief valve 86, and two additional plungers 87, 89 respectively control the relief valves 88, 90.

In order to insure that the torque is properly considered during shifting from forward in reverse, the control system comprises a suitable reversing gear, e.g., a reversing gear including the guide 41 of FIG. 9.

If the engine encounters a pronounced resistance immediately after starting, the torque-responsive regulator 71 transmits an appropriate signal. This causes the differential 72 to transmit a signal which opposes the signal from the governor 70. If the intensities of the two signals are identical or if the intensity of signal from the regulator 71 exceeds the intensity of signal from the governor 70, the engine cylinders are operated in parallel, i.e., there is no shift to compound operation. If the conditions change while the engine is in operation, the engine will be operated as a compound engine when the signal from the governor 70 prevails and in parallel when the intensity of signal from the regulator 71 prevails.

FIG. 12 shows an arrangement for replenishing the supply of working medium to compensate for losses due to leakage in the valves and/or engine cylinders. A condenser 91 supplies condensate to a collector vessel 92. A feed pump 93 draws fluid continuously from or close to the deepmost point of the vessel 92 and supplies the withdrawn fluid to the working circuit. In the event of losses in working medium (e.g., because of leakage in valves or past the piston sealing rings), the upper level of fluid in the vessel 92 descends whereby the pump 93 draws fluid from a reservoir 94 and admits such fluid to the evaporator of FIG. 13.

If the level of fluid in the vessel 92 reaches the upper end of a riser 95 forming part of a continuously driven control pump 96, the pump 96 conveys fluid into a control cylinder 97 in order to overcome the pressure differential between two pistons or lands 100 and 104 of the valving element 99. The initial pressure of the control pump 96 is balanced. A small quantity of fluid flows past a flow restrictor 98 and into the vessel 92. The valving element 99 in the cylinder 97 is shifted upwardly by pressure of fluid which is supplied by the control pump 96 and thereby overcomes the pressure of the column of fluid above the land 100 (head of the supply of liquid in the reservoir 94). The land 104 of the valving element 99 then opens the discharge port 101 for admission of fluid into the vessel 92 and a further land 102 of the valving element 99 opens a discharge port 103 of the cylinder 97. The land 104 seals the fluid admitting port 105. The control pump 96 then circulates condensate along an endless path defined by the cylinder 97, its port 101, and vessel 92. The intake of the pump 93 is connected with the vessel 92 by the cylinder 97.

The pump 93 supplies condensate from the vessel 92 into the working circuit, e.g., into the evaporator of FIG. 13. This takes place until losses due to leakage again cause the level of fluid in the vessel 92 to descend below the upper end of the riser 95.

When the pump 96 completes the evacuation of fluid which overflows into the riser 95, the land 104 of the valving element 99 is not subjected to the pressure of fluid which is supplied by the pump 96. This results in an equalization of pressure between the interior of the cylinder 97 and the vessel 92 (via flow restrictor 98). Therefore, the land 100 (whose effective surface, i.e., the upper surface, is larger), causes the valving element 99 to move to its lower end position and to seal the ports 101, 103 while opening the port 105.

The condenser 91 may contain a porous material (e.g., cooper wool) which is a good conductor of heat between the fluid to be condensed and the cooling fluid which is circulated by the piping shown in FIG. 12. The cooler for fluid in the condenser 91 is preferably designed to stand elevated pressures and includes means for dissipating heat energy which is received from the fluid to be condensed.

It is clear that the device 91 constitutes but one form of condenser means which can be used in or with the improved engine.

The evaporator of FIG. 13 comprises an inner section wherein the fluid comes in direct contact with a heater 106 and an outer section 108 which constitutes the aforementioned latent heat storing device. Still further, the evaporator comprises a plenum chamber 107. The section 108 includes a discrete heater 109. A temperature regulator 110 and a pressure regulator 111 insure that the equivalency of heat and pressure in accordance with the first law of thermodynamics is utilized in such a way that the temperature at least equals the lowest temperature in the supercritical range which still permits of lubrication by oil and the pressure is limited only by the ability of the material to withstand elevated pressures.

The inner section of the evaporator is filled with parallel pipes which convey condensate that is to be heated by the device 106. The chamber 107 stores primarily fluid which is fed by the pump 93. The device 108 is heated by the heater 109 (which may be of the type shown in FIG. 23) and by the contents of the inner section. Moreover, when the engine is installed in a vehicle, the device 108 can be heated by heat energy furnished by an eddy current brake.

The evaporator of FIG. 13 can be replaced with an evaporator which is heated by solar or nuclear energy.

FIG. 14 shows a twin differential piston control pump which is similar to or identical with the pump 96 of FIG. 12 and is driven directly by steams. This control pump comprises a first steam-operated working cylinder 112, a first pump cylinder 113, a second working cylinder 115 and a second pump cylinder 116. The two pairs of cylinders are coupled to each other by a yoke 114. The pistons of the left-hand cylinders 112, 113 are respectively shown at 117 and 118, and the pistons of the right-hand cylinders 115, 116 are respectively shown at 120 and 121. The two pairs of pistons are coupled to each other by a member 119. As shown, the piston 117 is further articulately connected with a connecting rod 122 receiving motion from a crank drive 123 which is journalled in the yoke 114. The regulation of steam admission is effected by a cam 124 and levers 126 which are actuatable by motion transmitting rods 125. The inlet and outlet ports are not shown. The shaft of the crank drive 123 can transmit motion to the pistons of two or more pumps in order to insure a more uniform flow of the pumped medium. For example, if the engine employs two control pumps, their cranks can be angularly offset by 90 degrees.

The pump of FIG. 14, constitutes but one form of means for pumping condensate so as to compensate for leakage of fluid past the valves and/or pistons of the engine cylinders. For example, each of the cylinders in the pump of FIG. 14 may constitute a double-acting cylinder. Furthermore, the pump of FIG. 14 can be replaced with a pump which is driven by a discrete motor, i.e., not by steam.

Referring to FIG. 15, there is shown a venting regulator. When the pressure in the evaporator of FIG. 13 reaches a predetermined value, the regulator of FIG. 16 initiates the venting of gas and evacuation of water from the main steam path. When the pressure in the cylinders of the engine reaches the preselected value, a switching unit 127 (see FIG. 2) opens the main inlet valve. The blocking device 33 (FIG. 7) for the selector 30 is not, as yet, actuated by the regulator of FIG. 15 and the cams 29 are not in the zero position. All relief valves are open. Steam flows through all working chambers without driving the engine. Steam which leaves the engine during aeration and removal of water is admitted into the cylinder 128 of FIG. 15 to flow in a channel or passage 129 past a needle valve 130, through a flow restrictor 131 and into the tank for storage of condensate. The piston 132 in the cylinder chamber 128 is subjected to the pressure of steam and displaces a plunger 133. The latter is associated with a suitable damping or cushioning device (not shown) and is coupled to the needle valve 130 by a linkage 134. The damping medium (oil or condensate) is displaced by the plunger 133 and flows through an adjustable flow restrictor 131*a* into a tank. The needle valve 130 seals the path for the flow of steam from the channel 129, i.e., the aerating step is completed. If the flowing steam (and, if necessary, a preheating device) effects sufficient accumulation of heat energy, the damping step can be terminated sooner by a bimetallic switch 135. Pressurized steam pushes the plunger 133 to the right-hand end position so that the linkage 134 closes the valve 130. Also, the linkage 134 closes or allows the valving element 9 of the inlet valve of FIG. 2 to close. If the engine is arrested for a short interval of time, the pressure of steam suffices to hold the piston 132 of FIG. 15 in the right-hand end position. When the engine is heated to a certain temperature (e.g., by the preheater), the switch 135 of FIG. 15 is actuated immediately.

When the venting regulator is in use, the relief valves are open. The main purpose of this regulator is to expel remnants of air and condensate from the system before the engine is started. This regulator can cooperate with suitable preheating means, such as the device 108 of FIG. 13 or with the heater 109. The aeration is preferably started automatically prior to starting of the engine and is terminated automatically by the plunger 133 which then closes the master valve 131, or by the switch 135.

FIGS. 16 and 17 show crossheads with roller bearings. The crosshead 136 for the upper steam piston and the forked crosshead 137 for the lower piston are journalled in the frame of the engine by means of roller bearings 138. The central crosshead is mounted in the bearings 139 and the fork is mounted in the bearings 138. The elongated roller bearings and also the semicircular bearings 140 for the head of the connecting rod are held against slippage by pinions 141 which are rotatably mounted on the cages of the bearings and respectively mesh with racks provided on the crosshead and the housing. The median connecting rod 142 is mounted in suitable roller bearings. In order to avoid spreading of the prongs of the fork, the bearing surfaces of the bearings 138 for the fork of the crosshead make a suitable (rather pronounced) angle with the axis of the crankshaft. Those sides of the connecting rod which face away from the semicircular roller bearing 140 are journalled in small slide bearing shells 143. The structure of FIGS. 16 and 17 may comprise automatic resetting means for the bearings.

The provision of roller bearings of the type shown in FIGS. 16 and 17 is desirable and advantageous because the crossheads are difficult to lubricate but are invariably subjected to very pronounced stresses. The roller bearings reduce friction and can stand long periods of use, even in the absence of constant lubrication. Similar bearings can also be used for other moving parts of the engine.

FIG. 18 shows an embodiment of the engine with X-shaped arrangement of cylinders. This insures that the channels for the flow of steam from cylinder to cylinder are short. Furthermore, such arrangement provides room for dual bearings for the crankshaft.

The crankshaft of the engine which embodies the structure of FIG. 18 is preferably mounted in twin bearings for each pair of pistons and the dimensions of the engine are such that it can stand any and all stresses which arise during operation. The cylinders are closely adjacent to each other. The crossheads of the pistons are coupled to first portions and the connecting rods are coupled to second portions of the crankshaft or eccentric shaft.

FIG. 19 shows a piston for the cylinder of the steam engine. This piston is provided with circumferentially complete sleeve-like rings 144, 145 and with a slip ring 146. These rings consist of a heat-resistant, elastic and self-lubricating material which may contain metallic reinforcing threads. The rings 144, 145 are subjected to pressure only at one side thereof; their other sides are relieved of pressure of creep steam due to the provision or bores 147 so that any steam which leaks past the rings can enter the housing of the crankshaft which is in communication with the atmosphere.

The slip ring may consist of several portions and may be made of graphite-containing Cermet.

The piston of FIG. 20 is designed for lubrication by oil. Owing to the equivalency of supplied heat energy and pressure, suitable regulators can be provided to insure that, after supplying a sufficient heat potential which allows for operation in the supercritical range, additional increase in energy can be achieved by increasing the pressure solely by pumping work without overheating. Lubrication of the cylinder at a temperature of 400° C. by resorting to known oil lubricants is possible without appreciable formation of carbon. The undesirable permeation of steam with oil, such as will occur when one uses split metallic rings, does not take place. The enrichment of steam with oil is prevented by resorting to circumferentially complete elastic oil stripping piston rings 148 consisting of suitable material (e.g., metallic filaments coated with Teflon) which cannot seal the oil admitting bores 149.

FIG. 21 shows a steam-operated biasing piston and a piston-like valving element with sleeve-like sealing rings 150, 152 and slide rings 151, 153 and 154.

Referring to FIG. 22, there is shown a regulator for the feed pump 93. Steam enters the regulator in the direction indicated by arrow and flow past a valve 155 to the feed pump. Steam is also caused to flow via bore 156 against the end faces of two differential pistons 157 and 158. The effective surface of the piston 157 is larger so that the overall pressure of fluid against this piston exceeds the pressure which is applied to the piston 158. Therefore, the piston 157 moves downwardly against the opposition of piston 158 and a helical spring 159 until the spring 159 stores sufficient energy to establish a state of equilibrium. The spring 159 is prestressed in dependency on steam pressure and the effective area of the piston 157 so that, when the operating pressure is reached, the valve 155 is closed to such an extent that the feed pump cannot effect a further rise in pressure. Operating pressure is regulated by suitable adjusting means, e.g., a screw 160. For an accurate balancing of evaporator pressure and the pressure in the interior of the condenser, for a condensation range which extends to the critical point, the condenser pressure is superimposed upon the regulated pressure by means of a piston 161 and linkage 162.

FIG. 23 shows a fuel evaporating unit for smoke-free ignition of liquid fuels. A tank 163 is permanently filled with fuel and contains an electrically heated spiral 164. When the heating means for the evaporator is turned on, the spiral 164 is heated to glowing temperature. The thus developing gaseous fuel causes the pressure in the tank 163 to rise and to displace a piston 165 against the opposition of a spring 166. When the pressure reaches a certain value, the piston rod of the piston 165 opens a switch 167 in the circuit of the spiral 164 and the piston rod also displaces an actuator 169 for a valve 170 which opens a path (conduit 168) for admission of gaseous fuel to the pilot light or to the spark plugs.

The unit of FIG. 23 may constitute the heater 109. The rate of fuel admission to the heater 109 can be regulated in a manner as shown in FIG. 23 or by the regulator 110 of FIG. 13. The switch 167 automatically terminates the admission of fuel to the heater 109 after a given interval of time, i.e., when the pressure drops sufficiently to enable the spring 116 to return the piston to the inoperative position, or when the regulator 110 closes the valve 170.

Other means which can heat the evaporator of FIG. 13 without generation of smoke can be used with equal advantage.

Figure 24:
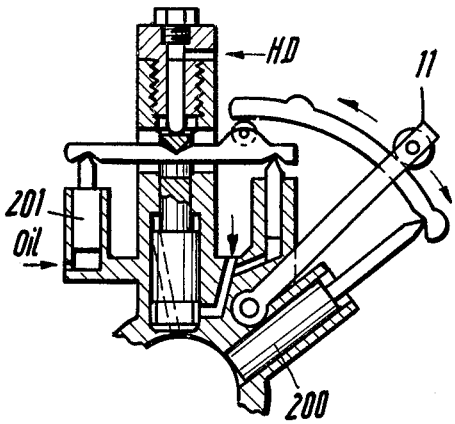
FIG. 24 is a sectional view of a further inlet valve.
Figure 25:
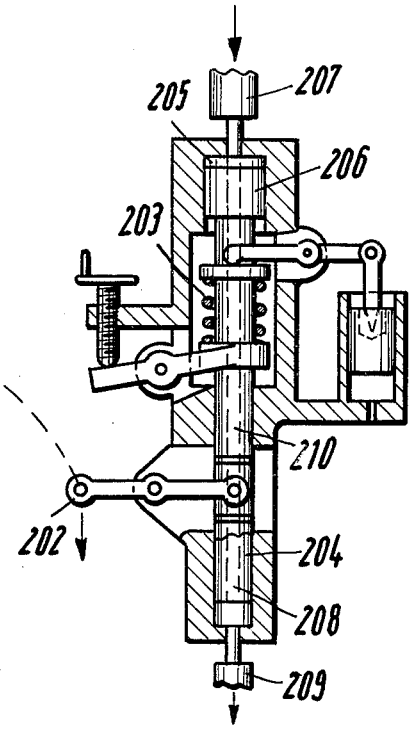
FIG. 25 is a sectional view of a regulator for the inlet valve of FIG. 24.

FIG. 24 illustrates a further inlet valve. This valve comprises a balancing cylinder 200 which cooperates with the engine cylinder. The opening lever engages the biasing piston 201 (corresponding to the piston 12 of FIG. 2). This insures a pressure limitation in cooperation with the piston of the balancing cylinder 200. The inlet valve of FIG. 24 can cooperate with a regulator of the type shown in FIG. 25. The steering member 11 is coupled with a lever 202 which can be pivoted by a spring 203 for the differential piston 204. The differential piston 204 is installed in a cylinder 205 whose thicker end portion 206 is provided with a steam admitting port 207 and whose thinner end portion 208 is provided with a steam evacuating port 209. Steam flows through a bore 210 of the differential piston from the port 207 to the port 209. In this manner, steam can pass through the regulator without appreciable throttling. The balancing piston is connected with the condenser.

Figure 26:
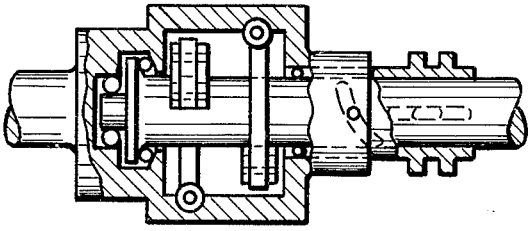
FIG. 26 is a sectional view of a modified torque-responsive regulator.
Figure 27:
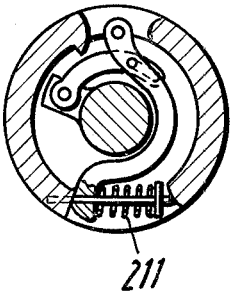
FIG. 27 is a transverse sectional view of the regulator of FIG. 26.

FIGS. 26 and 27 show a further torque-operated regulator. As clearly shown in the sectional view of FIG. 27, torque is opposed by an additional spring 211. This insures that the damping of the regulator is more pronounced so that the output of the engine can be increased more rapidly.

An advantage of the improved engine is that its thermal efficiency is more satisfactory than that of conventional engines. Furthermore, the weight of the engine per HP is lower and the controls and regulating devices are more flexible and more versatile than those in heretofore known steam engines.

In the improved steam engine, the working medium is conveyed along an endless path and condensation takes place by compression. The engine operates in the highest steam-liquid range and takes advantage of the pressure gradient in the supercritical range. Evaporation heat need be admitted only if the operating process is expanded to extend into the steam range. The weight of the engine is surprisingly low; this is attributed to the utilization of a relatively small counterpressure condenser and of an evaporator which employs thin-walled pipes and small auxiliary equipment. The time interval which elapses for heating the evaporator prior to starting of the engine is very short, and the evaporator can be readily insulated against excessive radiation losses. Breakage of one or more pipes in the evaporator cannot result in excessive damage because the jets of steam issuing from the broken pipes can be readily intercepted by a relatively thin steel jacket. The pump which force-feeds condensate to the evaporator is driven directly by steam and can be connected in parallel with one or more additional feed pumps. Uniformity of the rate of steam flow can be achieved by using a common system of cams or analogous control means.

By resorting to parts which do not require lubrication (for example, in a manner as known from the art of oxygen compressors), the engine can run without interruptions for a period of up to twelve months with negligible wear upon the engine cylinders. Such mode of operation reduces the initial and maintenance cost due to the absence of need for lubrication of the cylinders. However, and as explained above, the engine can be lubricated with oil in a novel and improved way which prevents mixing of steam with oil or other lubricant.

The volume of dead spaces in the improved valves is small, and the valves are preferably closed by steam; therefore, the number of strokes of valving elements per unit of time can be increased practically at will. The control unit is flexible and versatile, and its components react rapidly in response to each and every adjustment. The control unit and the improved valves insure reproducible filling of cylinders with steam and accurate selection of steam pressure. The selected values (i.e., those which are selected by manual adjustment of input elements, such as the selector 30 or 69) are superimposed upon adjustments effected by the regulator 71 or governor 70. Any and all adjustments are communicated, without delay, to the inlet valves and the associated biasing means.

If one wishes to achieve an optimum thermal efficiency, the cooling of condenser is reduced to a minimum. The internal pressure of the high-pressure condenser is communicated to the pump regulator of FIG. 22 (see the piston 161). The pressure in the condenser is so high that, after having passed through all of the cylinders, steam can be condensed in the highest steam-liquid range.

If one decides to sacrifice some thermal efficiency in order to achieve a higher output, the pump regulator of FIG. 22 selects a maximum steam pressure and the condenser is set to achieve a maximum cooling effect.

The engine can be equipped with means for preventing freezing, e.g., by withdrawing heat from the device 108 of FIG. 13 whenever the temperature drops to a lowest permissible value.

The improved engine is preferably a counterflow engine because such engines allow for maximum expansion of steam with a small number of cylinders.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a steam engine for conversion of all kinds of heat energy into mechanical energy; the combination of engine cylinder means; reciprocable piston means in said cylinder means; rotary output means driven by said piston means; inlet valve means for admission of steam into said cylinder means and relief valve means for evacuating fluid from said cylinder means, said valve means including valving means acted upon by the pressure of fluid in said cylinder in an opening sense; means for biasing said valve means to closed positions; means for constantly balancing the force with which said pressure acts upon said valve means in the opening sense so that said valve means is subjected solely to the biasing force of said biasing means in the closing sense both in the open and closed positions of said valve means variable-ratio motion transmitting means for superimposing an opening force proportionate to said pressure upon the biasing force furnished by the respective biasing means so that the action of the latter upon said valving means prevails over that of said pressure at selected values thereof, including selector means movable to a plurality of positions for varying the pressure of steam which is admitted into said cylinder means by way of said inlet valve means and means controlled by said selector means and operative for opening said valve means and for simultaneously changing the degree of filling of said cylinder means with steam in dependence on the position of said selector means; condenser means; pump means; regulating means for relating the pressure in said condenser means to the operation of said pump means so as to achieve an optimum thermal efficiency by raising the condensation point to a maximum or to achieve maximum output by lowering said point to a minimum; and means for controlling the operation of said transmitting means, including speed-responsive governor means for indicating the speed of the engine, torque-responsive regulator means for indicating the output torque of the engine, and transmission and switching means interposed between said regulator and governor means and said transmitting means, and operative for changing the performance of the engine in dependency on the instantaneous conditions by so adjusting said transmitting means as to achieve opening and/or closing of said valve means as a combined function of the indications furnished by said governor means and said regulator means.

2. The combination of claim 1, wherein said selector means includes adjustable cam means for controlling the movement of said valve means, starter means movable between a zero position and a plurality of working positions, means including a control shaft for effecting opening of said relief valve means and closing of said inlet valve means in said zero position, and means for releasably holding said starter means in the selected position and wherein said transmitting means further includes brake means for braking the engine, brake actuating means, and means for moving said cam means to neutral position in response to actuation of said brake means for discontinuing the driving operation of the engine during the braking thereof.

3. The combination of claim 2, wherein said brake means includes a steam-operated brake and at least one additional brake, and further comprising means for applying said steam-operated brake including means for adjusting said relief valve means to throttle the flow of fluid therethrough and for adjusting said inlet valve means to admit fluid into said cylinder, preferably in dependency on the braking action of said additional brake.

4. The combination of claim 1, wherein said biasing means is a hydraulically operated biasing means including means for pressurizing the hydraulic medium, piston means for biasing said valve means in response to the action of pressurized medium and means for eliminating clearances between said valve means and said biasing means when the engine is idle or while the engine is running.

5. The combination of claim 1, wherein said torque-operated regulator means includes damping means, axially or radially movable resilient means and means for changing the stress upon said resilient means in dependency on the magnitude of torque.

6. The combination of claim 1, further comprising evaporator means having a first heating section in direct contact with condensate, a plenum chamber, and a latent heat storing section at least partially surrounding said first section.

7. The combination of claim 1, wherein said condenser means contains a supply of porous material of high heat conductivity for the passage of steam and means for cooling the steam, said cooling means being in heat-conducting contact with said porous material.

8. The combination of claim 1, further comprising means for replenishing the supply of fluid to compensate for losses due to leakage from said cylinder means and/or valve means, including control pump means, a collecting vessel for condensate having an overflow opening for admission of condensate to said control pump means, a reservoir for condensate, and control means interposed between said first mentioned pump means and said control pump means for connecting said reservoir with said first mentioned pump means when said control pump means receives condensate from said vessel.

9. The combination of claim 8, wherein said control pump means comprises steam-operated twin piston pump means.

10. The combination of claim 1, further comprising regulator means for said pump means.

11. The combination of claim 1, further comprising means for aerating said cylinder means prior to starting of the engine.

12. The combination of claim 11, wherein said aerating means comprises damper means and means for deactivating said aerating means in response to rise of fluid temperature to a predetermined value.

13. The combination of claim 1, wherein said piston means comprises crosshead means and roller bearing means for said crosshead means.

14. The combination of claim 1, wherein said cylinder means includes a plurality of cylinders in X-formation.

15. The combination of claim 1, wherein said piston means comprises a plurality of sealing rings and at least one slip ring.

16. The combination of claim 1, further comprising means for heating the fluid prior to starting of the engine, including a source of evaporable fuel, means for evaporating said fuel, and means for conveying the gaseous fuel to a combustion station.

17. The combination of claim 1, further comprising means for heating the fluid, means for monitoring the temperature of fluid, and means for actuating said heating means when the temperature of fluid is below a predetermined range.

* * * * *